United States Patent [19]

Dyett et al.

[11] 4,276,891

[45] Jul. 7, 1981

[54] TRIMMING DEVICES FOR CIGARETTE-MAKING MACHINES

[75] Inventors: Derek H. Dyett; Jan A. Rakowicz, both of London, England

[73] Assignee: Molins Limited, London, England

[21] Appl. No.: 955,225

[22] Filed: Oct. 27, 1978

[30] Foreign Application Priority Data

Oct. 27, 1977 [GB] United Kingdom ..... 44673/77

[51] Int. Cl.[3] ..... A24B 5/18; A24B 5/30

[52] U.S. Cl. ..... 131/84 C; 83/174.1; 83/101

[58] Field of Search ..... 131/21 D, 84 C; 83/174.1, 101

[56] References Cited

U.S. PATENT DOCUMENTS 3,608,562 9/1971 Goman ..... 131/21 D 3,769,989 11/1973 Labbe ..... 131/21 D

FOREIGN PATENT DOCUMENTS 742932 9/1966 Canada ..... 131/21 D

*Primary Examiner*—V. Millin

*Attorney, Agent, or Firm*—Craig and Antonelli

[57] ABSTRACT

A trimming device for trimming the cigarette filler stream in a cigarette making machine comprises a first fixed blade and a first rotating brush member which cooperate to remove from the tobacco stream tobacco lying further than a first predetermined distance from the tobacco conveyor; a second fixed blade and a second rotating brush member which are situated upstream or downstream of the first blade and brush member and cooperate to remove tobacco at regular spaced intervals corresponding to portions of the stream forming intermediate sections of the filler for each finished cigarette, the second blade being set at a second predetermined distance from the tobacco conveyor which is smaller than the first predetermined distance.

9 Claims, 9 Drawing Figures

TRIMMING DEVICES FOR CIGARETTE-MAKING MACHINES

A common form of cigarette-making machine is basically described in British patent specification No. 881,024. The machine includes means for forming a tobacco stream which is conveyed by a suction conveyor and is acted upon by a trimming device which removes some of the tobacco to produce a substantially uniform cigarette filler stream, or a filler stream having predetermined variations having, for example, what are termed "dense end portions." Examples of such machines are the Molins Mark 8 and Mark 9 cigarette making machines.

The present invention is concerned with modified forms of trimming device for use in such cigarette making machines.

According to one aspect of this invention, a trimming device comprises a first fixed blade and a first rotating brush member which cooperate to remove from the tobacco stream tobacco lying further than a first predetermined distance from the tobacco conveyor; a second fixed blade and a second rotating brush member which are situated upstream or downstream of the first blade and brush member and cooperate to remove tobacco at regular spaced intervals corresponding to portions of the stream forming intermediate sections of the filler for each finished cigarette (i.e. portions of the cigarettes which will be inwardly spaced from the ends of the finished cigarettes), the second blade being set at a second predetermined distance from the tobacco conveyor which is smaller than the first predetermined distance.

More specifically, a trimming device according to this invention preferably comprises a first fixed blade and a first rotating brush member which cooperate to remove from the tobacco stream tobacco lying further than a first predetermined distance from the tobacco conveyor; the operative edge of the first blade being arranged to lie substantially across the path of the tobacco stream (preferably obliquely across it); a second fixed blade and a second rotating brush member which are situated upstream or downstream of the first blade and brush member and cooperate to remove tobacco at regularly spaced intervals corresponding to portions of the stream forming intermediate sections of the filler for each finished cigarette (i.e. portions of the cigarettes which will be inwardly spaced from the ends of the finished cigarettes), the second blade being set at a second predetermined distance from the tobacco conveyor which is smaller than the first predetermined distance, and the operative edge of the second blade being arranged to lie along one side of the tobacco stream.

Each brush member preferably comprises a solid metal body including approximately radially extending vanes which are arranged to sweep away discard tobacco (i.e. tobacco removed by the trimming device) from the filler stream, preferably sideways or with a sideways component. The two brush members are preferably coaxial and are preferably integral.

Each blade (or at least one) may be arranged to contact the corresponding brush member and to be sharpened by such contact. It may be advanced slowly towards the filler stream (either continuously or intermittently) to compensate for the removal of material from the operative edge of the blade by the sharpening and by the abrasiveness of the tobacco. For this purpose the brush member may be formed at least at its periphery from tungsten carbide or some other hard material. Each blade may, for example, be formed from spring steel which may be surface-hardened (e.g. by ion implantation) to provide a wear resistant surface while retaining a degree of flexibility of the blade as a whole.

According to another aspect of this invention, a trimming device for a cigarette making machine comprises a fixed blade which cooperates with a rotating brush member to remove discard tobacco, the blade being arranged to contact the periphery of the brush member and to be sharpened by such contact. There is preferably provision for advancing the blade towards the tobacco stream as already mentioned in relation to the first aspect of this invention.

According to another aspect of this invention, a trimming device for a cigarette making machine comprises a blade of curved cross-section which cooperates with a rotating brush member having a corresponding periphery of concave cross-section whereby the cigarette filler stream left by the trimming device has a concave outer surface in cross-section. This reduces the work which has to be done in shaping the filler stream to a circular cross-section after trimming and before the filler stream is enclosed in a wrapper to form a continuous cigarette rod.

Examples of trimming devices according to this invention are shown in the accompanying drawings. In these drawings.

Figure 1:
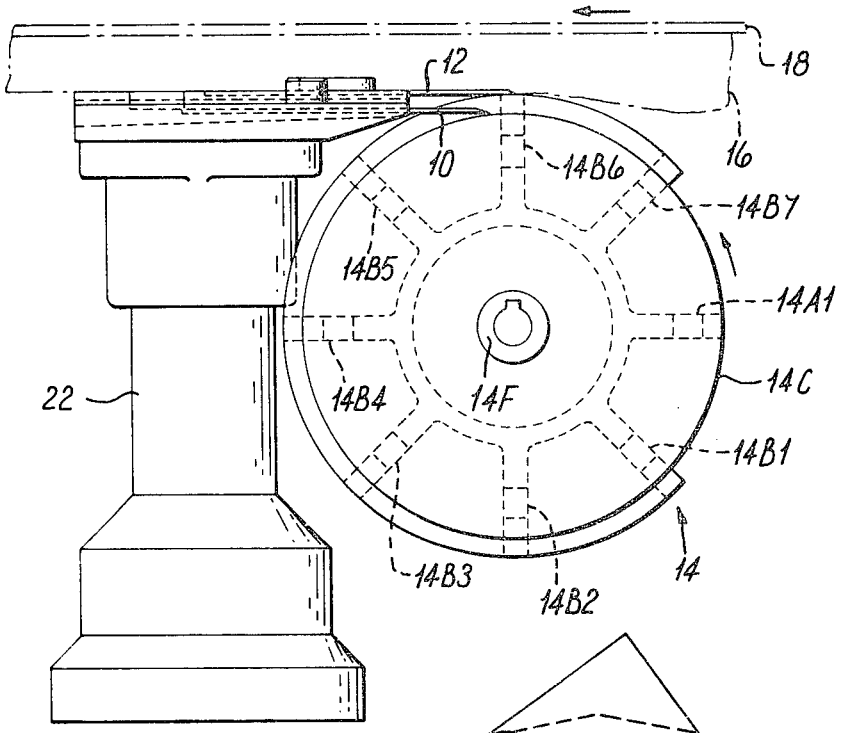
FIG. 1 is an elevation of one trimming device in the direction of the axis of the rotary brush member.
Figure 2:
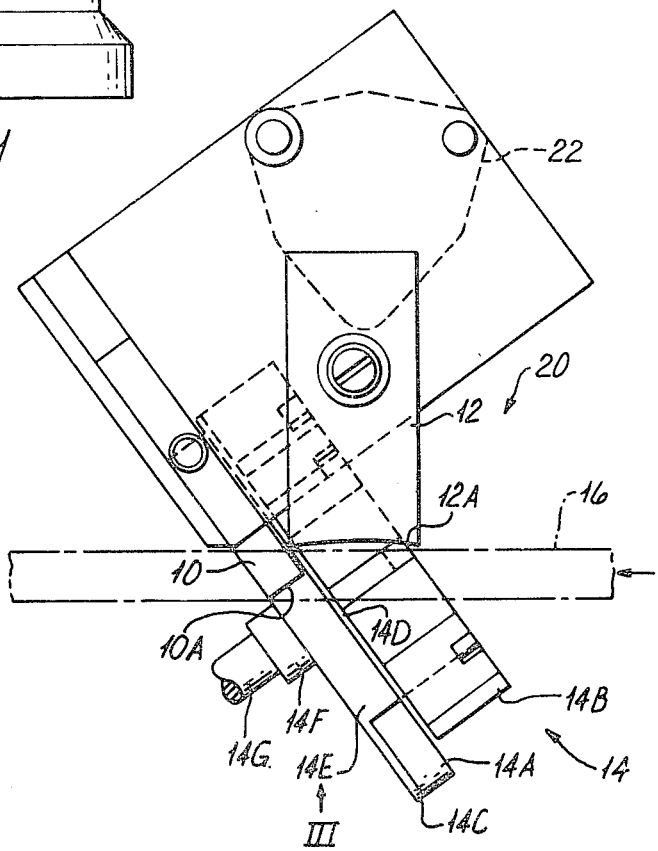
FIG. 2 is a plan view of the trimming device shown in FIG. 1.
Figure 3:
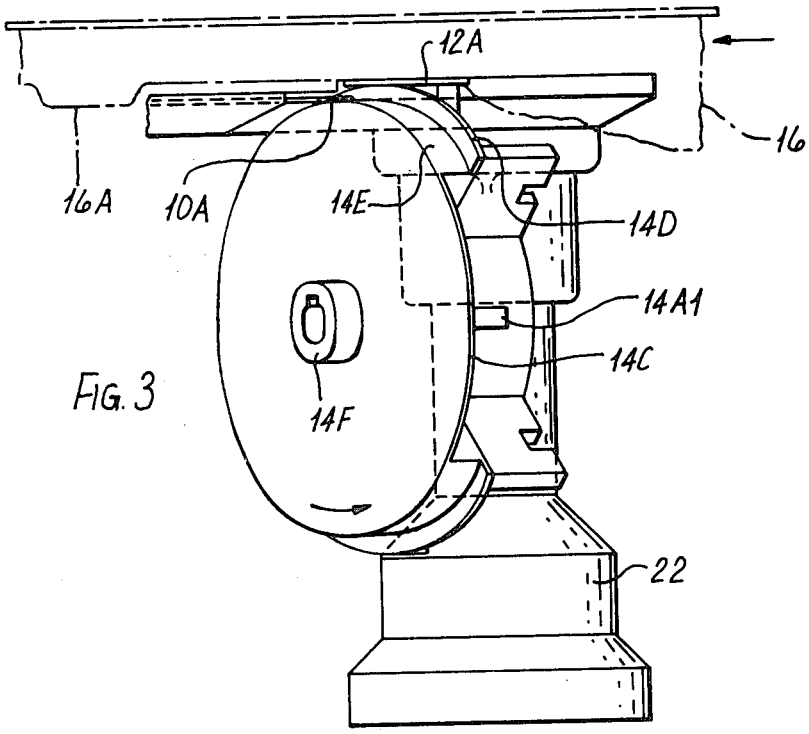
FIG. 3 is a side elevation in the direction of the arrow III in FIG. 2.

The trimming device shown in FIGS. 1 to 3 includes first and second fixed blades 10 and 12 cooperating with rotary brush members 14A and 14B which form part of an integral brush member 14. A tobacco stream 16 is carried by a suction band 18 in the direction shown by the arrow in each view.

As shown particularly in FIG. 1, the brush member 14B includes 7 radial vanes 14B1 to 14B7. These cooperate with the operative edge 12A of the blade 12 to remove tobacco lying below the blade 12, except in the region of dense end portions of the tobacco stream. The circumferential gap between vanes 14B1 and 14B7 allow the dense end portions of the tobacco stream to pass the brush member 14B and blade 12 without being trimmed. It should be noted that the operative edge 12A of the blade 12 lies along one side of the tobacco stream so as not to interfere with the dense end portions of the stream.

The dense end portions of the stream are then trimmed by the blade 10 and the cooperating brush member 14A. For this purpose the brush member 14A has at least one vane 14A1 in the gap between the vanes 14B1 and 14b7; there may be additional vanes all extending radially only as far as the periphery of a thin disc portion 14C which, together with the blade 10, serves as a barrier preventing passage past the trimming device of tobacco lying below the operative edge 10A of the blade 10. A thin flange portion 14D similarly serves as a barrier for tobacco below the blade 12, except between the vanes 14B1 and 14B7.

It should be noted that the operative edge 10A of the blade 10 lies approximately transverse to the direction of movement of the tobacco stream. During rotation of the brush member, the edge 10A engages and is sharpened by contact with a cylindrical surface 14E extending approximately 270° around the axis of the brush member, i.e. except in the region between vanes 14B1 and 14B7 where it is cut away to receive the dense end portions which are trimmed by the blade 10 and the cooperating vane or vanes 14A1.

It should also be noted that the operative edge 12A of the blade 12 is slightly concave since it engages and is sharpened by contact with the outer surfaces of the vanes 14B1 to 14B7. In contrast, the edge 10A of the blade 10 is parallel to the axis of rotation of the brush member 14, so that it can be straight.

A blade feed mechanism (of any known kind) may be provided for advancing for advancing each blade in the direction of its length and towards the tobacco stream. Alternatively, each blade (or at least one) may be fixed in position, may have its operative edge slightly spaced from the brush member and may be made of sufficiently hard material to withstand the abrasiveness of the tobacco for a significant period of operation.

The brush member 14 has a central boss 14F by which it is mounted on and keyed to a drive shaft 14G (FIG. 2).

It will be understood that the brush member 14 makes one revolution for each cigarette produced by the machine, e.g. at a rate of 4000 per minute. The length of the finished cigarettes is typically about 70 mm. On that basis FIG. 3 shows the approximate position of one dense end portion 16A left by the trimming device. The height of the lump of tobacco forming the dense end portion 16A is determined by the distance of the blade 10 from the band 18; the height of intermediate portions of the tobacco stream after trimming (i.e. the major proportion of the stream) is determined by the distance of the blade 12 from the band 18.

In the arrangement shown in FIGS. 1 to 3, the blade 12 which is closer to the suction band 18 lies upstream of the blade 12. As an alternative, the reverse may be used. In other words, the tobacco stream may be first arranged to pass a lower blade which removes all tobacco below the level of that blade, after which further quantities are removed at regular intervals in areas lying between the dense end portions of the tobacco stream.

The trimming device includes a carrier member 22 on which the blades are mounted and which also carries the drive shaft 14F on which the rotary brush member is mounted. The entire trimming device may be controlled as to its vertical position (in a basically known manner) in response to a weight control device so as to control the amount of tobacco left on the suction band 18 after trimming.

Figure 4:
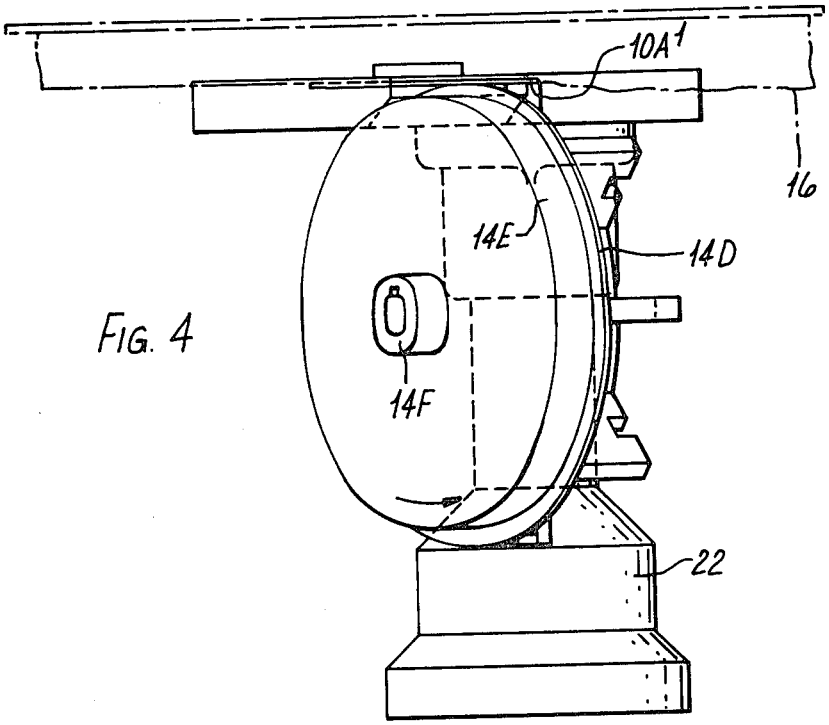
FIG. 4 is a similar side elevation of a second trimming device.
Figure 5:
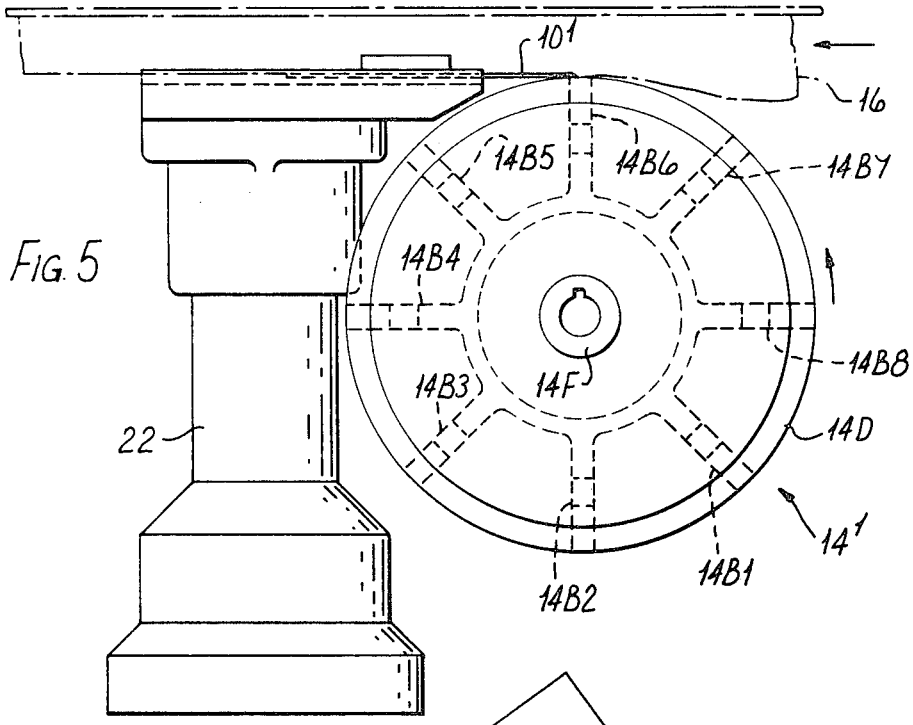
FIG. 5 is an elevation in the direction of the axis of the rotary brush member of the device shown in FIG. 4.
Figure 6:
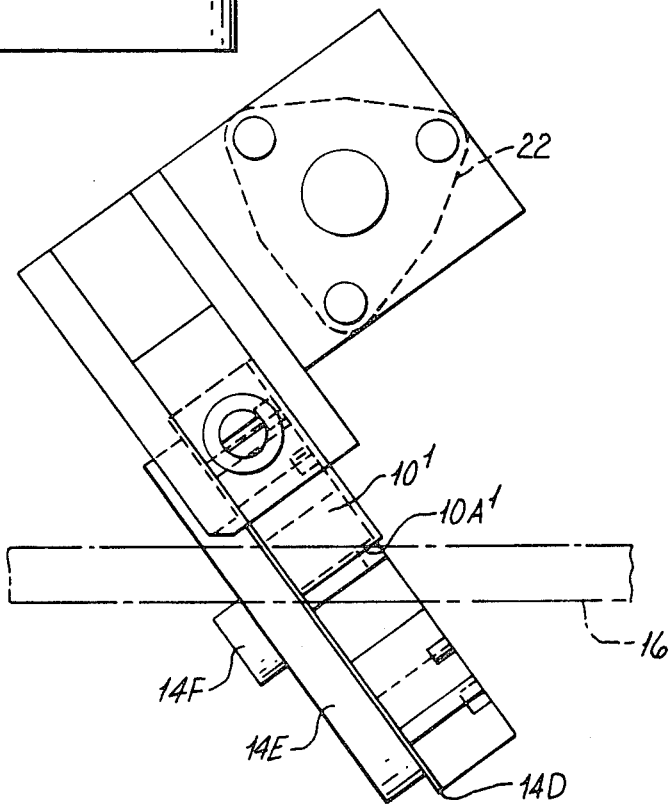
FIG. 6 is a plan view of the device shown in FIGS. 4 and 5.

FIGS. 4 to 6 show a trimming device which is similar to that shown in FIGS. 1 to 3, except that no provision is made for producing dense end portions in the finished cigarette filler stream. Parts which are similar to or the same as those shown in FIGS. 1 to 3 are identified by similar or the same reference numerals. The parts include in particular a single fixed blade 10' and a rotary brush member 14' which is similar to the brush member 14 shown in FIGS. 1 to 3, except that an additional radial vane 14B8 is provided, and that the flange 14D extends all the way around the trimming member, there being no cut-away parts as in the first example.

In contrast to the first example, however, the blade 10' has its operative edge 10A' extending obliquely substantially right across the tobacco stream 16. The edge 10A' may be arranged to be engaged and sharpened by the outer surfaces of the vanes 14B1 to 14B8 as mentioned in relation to the first example; alternatively, the blade 10 may simply be replaced from time to time when its edge wears away. The edge 10A' is straight since it is parallel to the axis of rotation of the brush member 14'.

It should be noted that, in both examples described above, the region of the brush member adjacent to the tobacco stream moves towards the blade or blades in a direction inclined to the direction of movement of the tobacco stream and with a component of motion in that same direction of movement.

In the devices shown in FIGS. 1 to 6 the vanes of each brush member (or at least the outer edges thereof) may be inclined to the axis of rotation of the brush member instead of being parallel to the axis.

Figure 7:
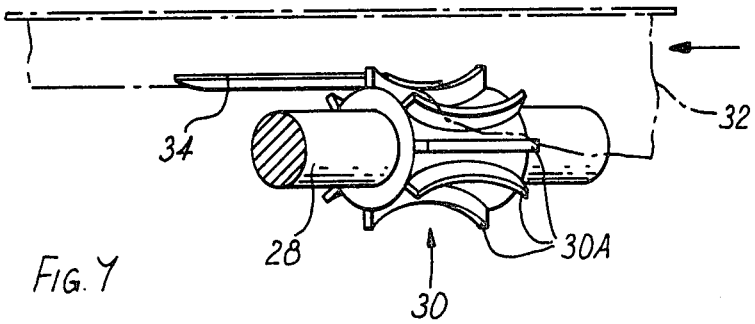
FIG. 7 is a side elevation of a third trimming device.
Figure 8:
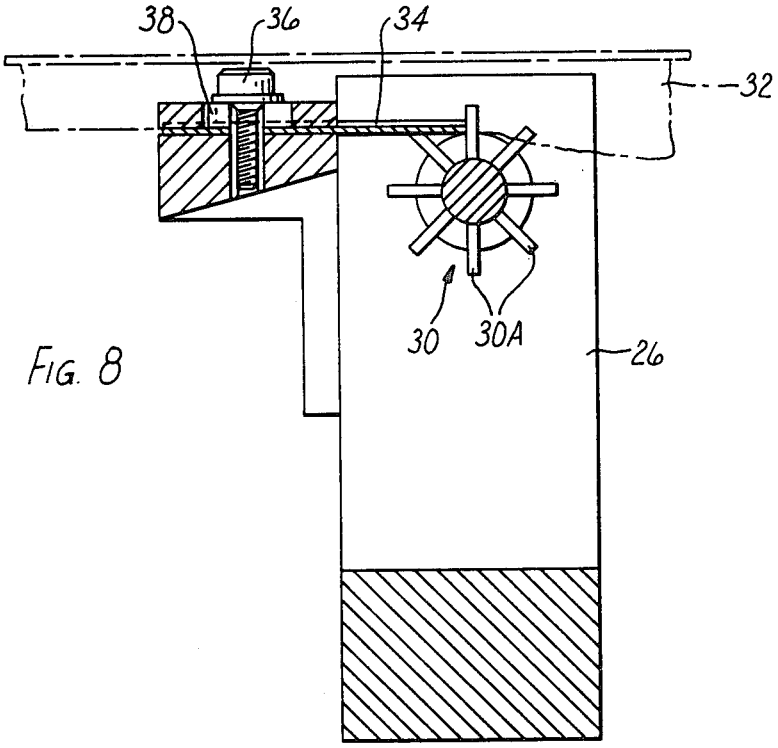
FIG. 8 is a partly sectioned elevation in the direction of the axis of the brush member of the device shown in FIG. 7.
Figure 9:
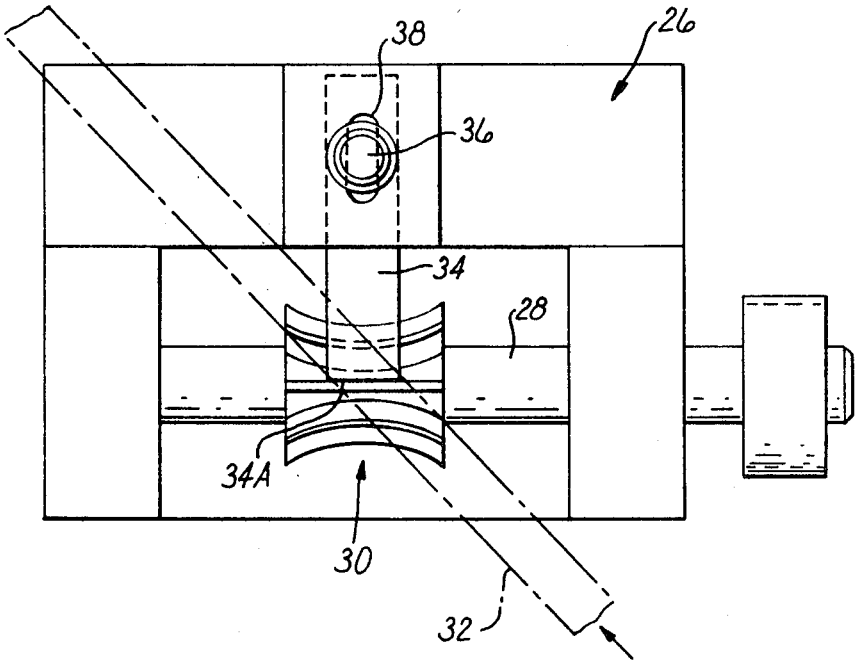
FIG. 9 is a plan view of the device shown in FIGS. 7 and 8.

FIGS. 7 to 9 show a third example of a trimming device according to this invention. A carrier member 26 has mounted on it a shaft 28 carrying a rotary brush member 30 formed with 8 evenly spaced radial vanes 30A. A filler stream 32 and its direction of motion are shown particularly in FIG. 9.

Each of the vanes 30A has a concave outer edge, and the blade 34 is correspondingly curved in cross-section. The arrangement is such that the operative edge 34A of the blade 34 engages or is only slightly spaced from the outer edges of the vanes along its entire length. In the arrangement shown, the blade 34 is secured in position by a screw 36 which passes through a slot 38 to allow periodic manual adjustment of the position of the blade; as an alternative, the blade may be advanced continuously towards the rotary brush member, assuming that its operative edge is arranged to contact and to be sharpened by the brush member. It will be appreciated that, with this trimming device, the outer surface of the tobacco stream 32 after trimming is convex in cross-section.

Instead of the outer edges of the vanes 30A being concave in a curved manner, they could have a faceted shape, e.g. a truncated V-shape.

We claim:

1. A trimming device for trimming cigarette filler stream in a cigarette making machine comprising a first fixed blade and a first rotating brush member which cooperate to remove from the tobacco stream tobacco lying further than a first predetermined distance from the tobacco conveyor; a second fixed blade and a second rotating brush member which cooperate to remove tobacco at regular spaced intervals corresponding to portions of the stream forming intermediate sections of the filler for each finished cigarette, the second blade being set at a second predetermined distance from the tobacco conveyor which is smaller than the first predetermined distance.

2. A trimming device for trimming a cigarette filler stream in a cigarette making machine comprising a first fixed blade and a first rotating brush member which cooperate to remove from the tobacco stream tobacco lying further than a first predetermined distance from the tobacco conveyor, the operative edge of the first blade being arranged to lie substantially across the path of the tobacco stream; a second fixed blade and a second rotating brush member which cooperate to remove tobacco at regularly spaced intervals corresponding to portions of the stream further intermediate sections of the filler for each finished cigarette, the second blade being set at a second predetermined distance from the tobacco conveyor which is smaller than the first predetermined distance, and the operative edge of the second blade being arranged to lie along one side of the tobacco stream.

3. A trimming device according to claim 1 or claim 2 in which each brush member comprises a solid metal body including approximately radially extending vanes which are arranged to sweep away discard tobacco from the filler stream.

4. A trimming device according to claim 3 in which the two brush members are coaxial.

5. A trimming device according to claim 3 in which at least one blade is arranged to contact the corresponding brush member and to be sharpened by such contact, and is movable towards the brush member to compensate for wear of the operative edge of the blade.

6. A trimming device according to claim 1 or claim 2 in which the brush members, in the region of the tobacco stream, move towards the blades in a direction inclined to the direction of movement of the tobacco stream and with a component in that same direction of movement.

7. A trimming device according to claim 2 in which the second rotary brush member has a peripheral recess to allow dense portions of the filler stream to pass the second blade without being removed by the second brush member.

8. A trimming device for trimming a cigarette filler stream in a cigarette making machine, comprising a fixed blade which cooperates with a rotating brush member to remove discard tobacco, the blade being arranged to contact the periphery of the brush member and to be sharpened by such contact.

9. A trimming device for trimming a cigarette filler stream in a cigarette making machine, comprising a blade of curved cross-section which cooperates with a rotating brush member having a corresponding periphery of concave cross-section whereby the cigarette filler stream left by the trimming device has a concave outer surface in cross-section.

* * * * *